US006905232B2

(12) United States Patent
Lin

(10) Patent No.: US 6,905,232 B2
(45) Date of Patent: Jun. 14, 2005

(54) VIBRATION RESISTANT LAMP STRUCTURE

(76) Inventor: Benny Lin, 6423 E. Washington Bl., Commerce, CA (US) 90040

( * ) Notice: Subject to any disclaimer, the term of this patent is extended or adjusted under 35 U.S.C. 154(b) by 24 days.

(21) Appl. No.: 10/458,313

(22) Filed: Jun. 11, 2003

(65) Prior Publication Data

US 2004/0252508 A1 Dec. 16, 2004

(51) Int. Cl.[7] ..... F21V 21/00
(52) U.S. Cl. ..... 362/374; 362/369; 362/375
(58) Field of Search ..... 362/374, 362, 362/369, 375, 546, 459, 487, 548, 549, 226, 257; 215/342, 44, 227, 231, 234, 293, 341; 220/3.8, 288, 780, 315; D26/113, 118, 119, 138, 139

(56) References Cited

U.S. PATENT DOCUMENTS 1,514,960 A * 11/1924 Godley ..... 362/506
1,667,653 A * 4/1928 Cizek ..... 362/506
3,716,161 A * 2/1973 Julian et al. ..... 215/342
4,450,508 A * 5/1984 Carley ..... 362/105
4,489,367 A * 12/1984 Herron et al. ..... 362/311
5,477,441 A * 12/1995 Budnovitch et al. ..... 362/362
5,560,707 A * 10/1996 Neer ..... 362/375
5,758,958 A * 6/1998 Chen ..... 362/507
5,927,532 A * 7/1999 Traub ..... 215/342
5,988,833 A * 11/1999 Giese et al. ..... 362/287
6,702,454 B2 * 3/2004 Grajetzky et al. ..... 362/365

* cited by examiner

*Primary Examiner*—John Anthony Ward
*Assistant Examiner*—Ismael Negron
(74) *Attorney, Agent, or Firm*—Troxell Law Office, PLLC

(57) ABSTRACT

A lamp structure including a lamp housing, and a circular ring piece, a lamp holder, and a lamp locking-collar all assembled in the lamp housing sequentially. The lamp housing has holes on a surface for extending a wire through and has a stepped portion on an inner wall. The circular ring piece is placed in the lamp housing supported and fixed by the stepped portion. The lamp holder has a space for receiving a lamp bulb, and a protrusion on an external periphery engaging a notch provided on an adjustable compressible portion when the lamp holder is mounted. The lamp holder abuts against and is fixed on the circular ring piece. The lamp locking-collar and the lamp housing both have grooves for an elongated member (spring). The lamp locking-collar has gaskets for a waterproof seal.

9 Claims, 4 Drawing Sheets

VIBRATION RESISTANT LAMP STRUCTURE

BACKGROUND OF THE INVENTION

1. Field of the Invention

The present invention is related to a lamp structure improved for assembling, especially in its convenience to assemble. The purpose is to secure a lamp holder inside a lamp housing and simultaneously avoiding vibration of the lamp set. The structure is suitable for all land, sea and air traffic vehicles etc. as well as for illuminating lamps such as spotlights and searchlights.

2. Description of the Prior Art

As shown in FIG. 1, a schematic view showing the mode of assembling, a conventional lamp 1 comprised of a lamp housing 10, a lamp holder 11, and a locking collar 12. Wherein the lamp housing 10 has an opening 101 and an inner thread 102 on the inner side of the lamp housing 10; the locking collar 12 correspondingly has an external thread 103 on the outer side thereof; thereby in assembling after the lamp holder 11 is placed in the lamp housing 10, the locking collar 12 can be connected and locked onto the lamp housing 10 to form a lamp set.

Generally speaking, the lamp holder 11 mounted in the lamp housing 10 is manufactured and vended together with the lamp housing 10 and the locking collar 12 depends on the original manufacturer; taking a lamp for a vehicle as an example, the lamp holder 11 is changed in pursuance of a consumer's preference when it is damaged; there are many manufacturers of lamp housing in the market, while a consumer does not have to get the exact same lamp holder made by the original manufacturer is much easier on the consumer. However, a lamp holder 11 not made by the same manufacturer may have some size variation from the lamp housing 10. If it is too small, a gap may exist after mounted which results to water permeation, or the gap may induce vibration of the lamp holder 11; while if it is too large, it is unable to be aligned and placed in the lamp housing 10.

Moreover, after activating an engine of a vehicle, it creates irregular shaking and vibration, particularly when driving on an uneven surfaced road. During driving, the engine of a car or a motorcycle rotates under different high speeds which makes the locking collar 12 come loose or rotate toward the direction against the thread, hence the locking collar 12 drops and causes an accident.

Furthermore, the wall of the lamp housing 10 is very thin. During the process of manufacturing, it is difficult to establish the inner thread 102 and easy to deviate, thereby, the opening of the lamp housing 10 with the thread is subject to the mounting of the lamp holder 11 onto the lamp housing 10 being hard or even unable to lock the locking collar 12.

In view of this, the present invention is developed to improve the drawbacks of the conventional lamp.

SUMMARY OF THE INVENTION

The purpose of the present invention is to provide a lamp structure improved for convenience in assembling and for the lamp to be installed securely and avoid vibration of the lamp set thus render driving safety.

To achieve the above goal, the present lamp structure invented comprises of: a lamp housing shaped like a cone barrel with a receiving space, the housing has holes on the surface for extending a wire through, and the inner wall has a stepped portion that comes with an engagement block; a circular ring piece to be placed in the lamp housing and supported by the stepped portion, a recess on the external periphery of the circular ring piece to make engagement of the block in the recess, and there is at least one convex compressible ridge with a notch on the ring piece; a lamp holder with a receiving space for a lamp bulb and a protrusion on its external periphery to be engaged in the notch on the ring piece; a lamp locking-collar that is a circular sleeve with a reduced neck portion, being connectable to the lamp housing when the ring piece and the lamp holder are sequentially placed in the lamp housing.

The present invention will be apparent after reading the detailed description of the preferred embodiment thereof in reference to the accompanying drawings.

DETAILED DESCRIPTION OF THE PREFERRED EMBODIMENT

Figure 1:
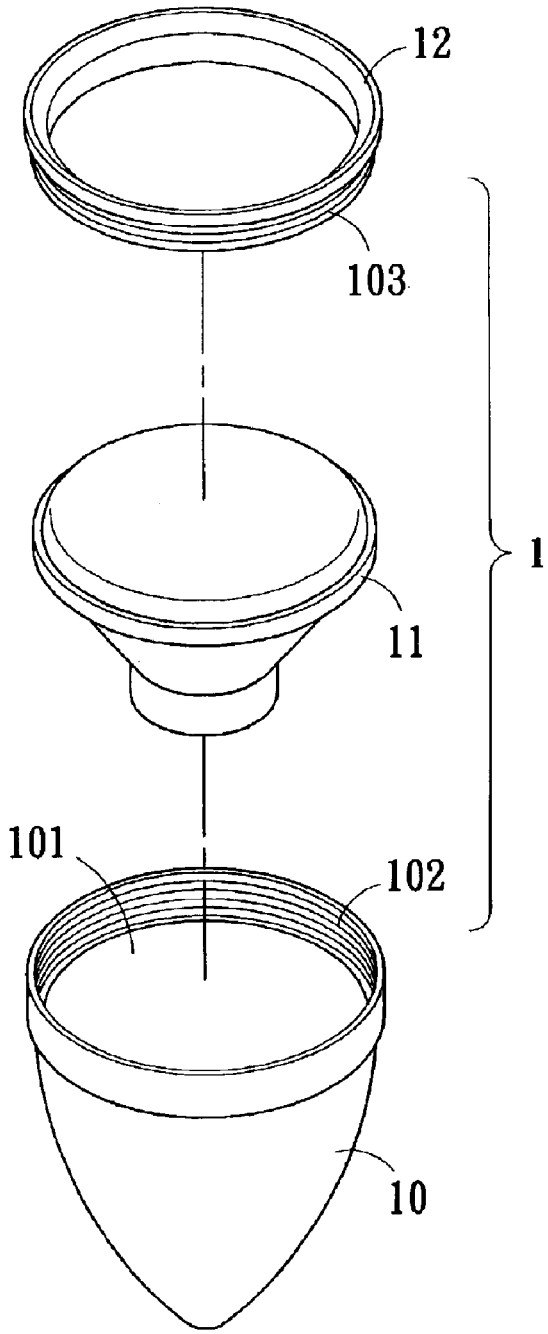
Fig. 1 (Prior Art)
FIG. 1 is an analytic perspective view showing the elements of a conventional lamp.
Figure 2:
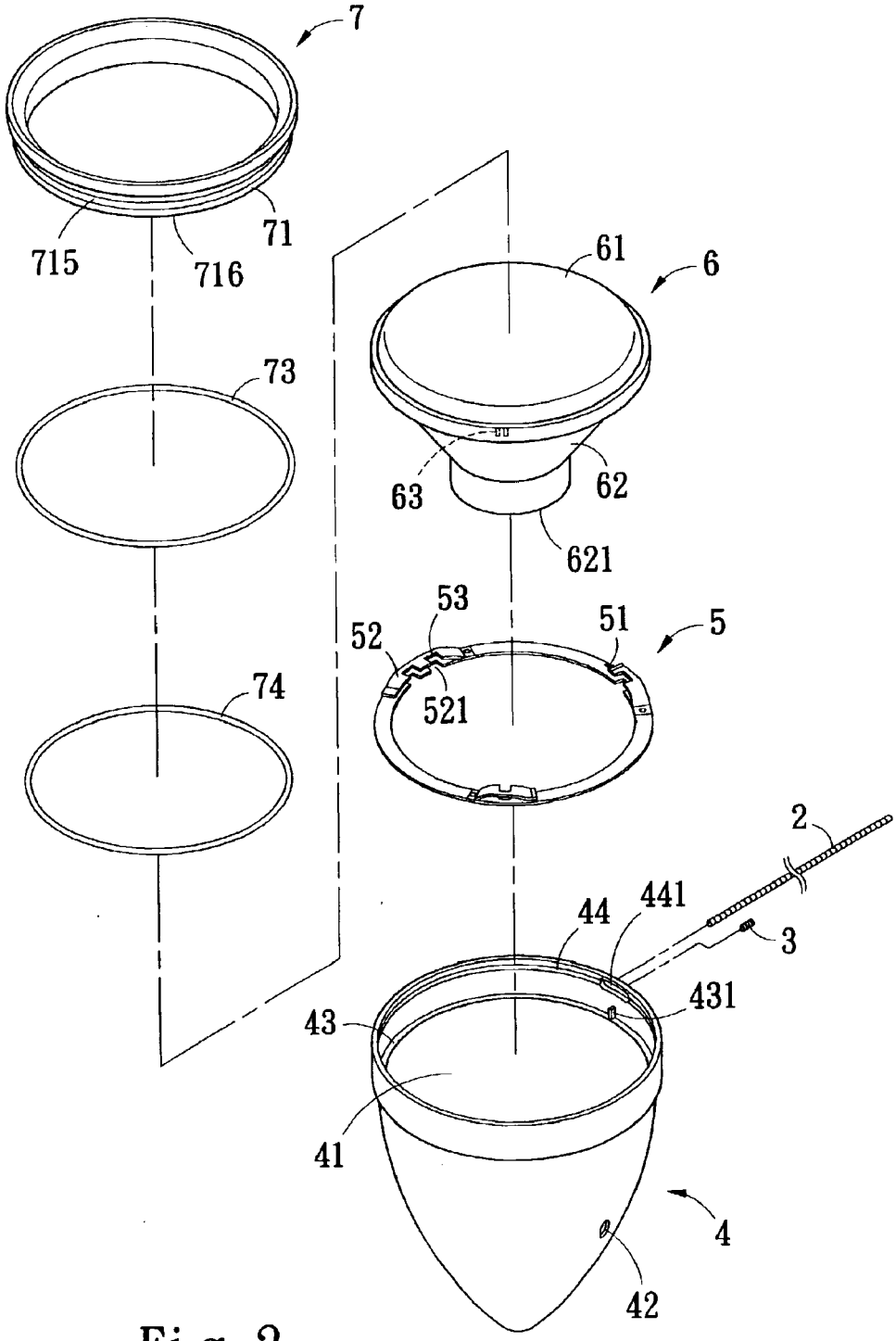
FIG. 2 is an analytic perspective view showing the elements of the embodiment of the present invention.
Figure 3:
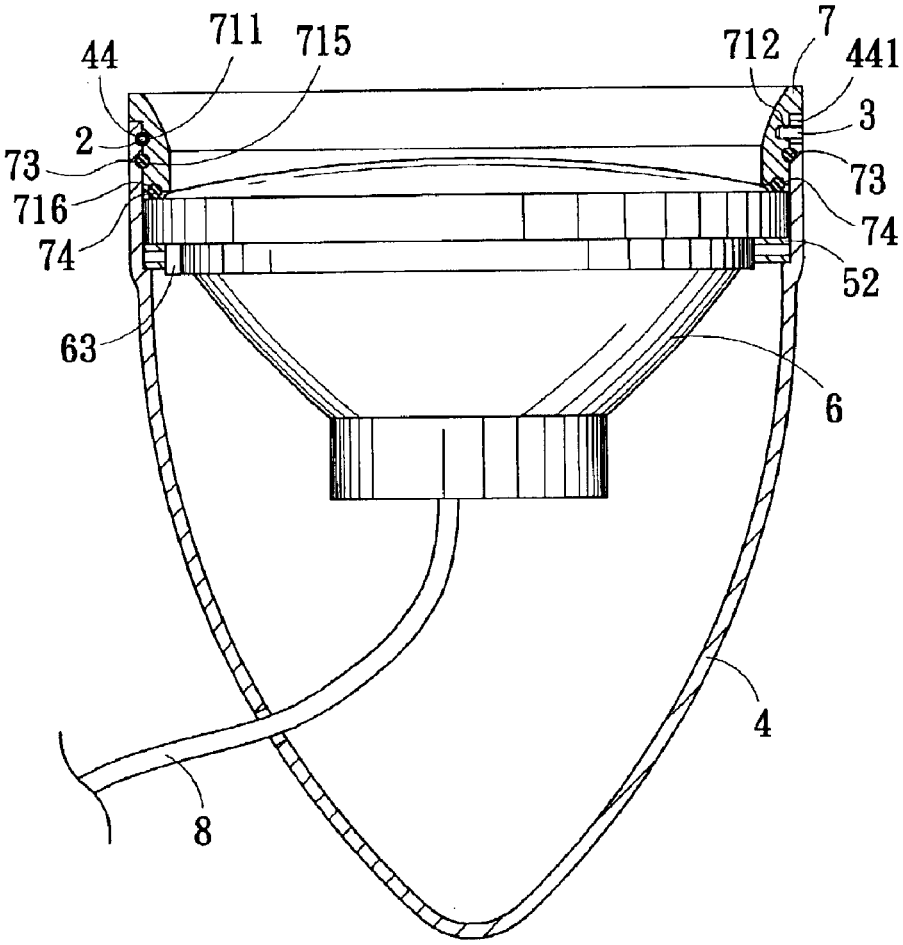
FIG. 3 is a schematic sectional view showing the state of assembled elements of the embodiment of the present invention.

Referring to FIGS. 2 and 3 showing an embodiment of the improved lamp structure improved for assembling of the present invention, the lamp structure comprises: a lamp housing 4, as well as a circular ring piece 5, a lamp holder 6 and a lamp locking-collar 7, these members are sequentially mounted in the lamp housing 4.

Wherein the lamp housing 4 is a cone-shaped barrel with a receiving space 41, the housing 4 has holes 42 on the surface for extending an electrical wire 8 through, and a stepped portion 43 on the inner wall provided with an engagement block 431.

The circular ring piece 5 is placed in the lamp housing 4 and supported by the stepped portion 43. An engagement recess 51 is provided on the external periphery of the circular ring piece 5 to make engagement of the block 431 in the recess 51; and on one side of the circular ring piece 5 there is at least one compressible ridge 52 that is formed by point welding mutually spaced steel sheets onto the circular ring piece 5; the circular ring piece 5 and the compressible ridge 52 has respectively notches 521, 53 aligned with each other.

The lamp holder 6 is formed by connecting the ends of a cover 61 and a shell 62, the shell 62 has an opening 621 on the other end with predetermined size for receiving a lamp bulb and has therein a space for receiving the bulb. The lamp holder 6 has a protrusion 63 on the external periphery thereof to be engaged in the notch 53 provided on the compressible ridge 52 when the lamp holder 6 is mounted; the lamp holder 6 abuts against the circular ring piece 5 to thereby be fixed on it.

The lamp locking-collar 7 is a circular sleeve with a reduced neck portion 71; it is connectable to the lamp holder 6 when the circular ring piece 5 and the lamp holder 6 are sequentially placed in the lamp housing 4. The reduced neck portion 71 provided on the front end wall of the lamp locking-collar 7 has grooves 715, 716 with gaskets 73, 74 respectively therein; so that after the lamp locking-collar 7 is connected with the lamp housing 4, the gasket 73 provides an auxiliary effect of preventing the lamp locking-collar 7 from dropping off and an upper-area waterproof effect, the gasket 74 derives the absolute waterproof effect by the fact that it presses against the cover 61 of the lamp holder 6.

For the purpose of increasing stability of connecting the lamp locking-collar 7 with the lamp housing 4, the reduced neck portion 71 on the lamp locking-collar 7 is provided thereon with a groove 711 and a screw hole 712 therein; the lamp housing 4 is provided on the inner wall thereof also with a groove 44 in corresponding with the groove 711 of the lamp locking-collar 7, the groove 44 has a through hole 441 to make passage when the grooves 711, 44 are aligned with each other in connecting of the lamp locking-collar 7 with the lamp housing 4. The screw hole 712 and the through hole 441 respectively of the groove 711 and the groove 44, are located at the same side of the lamp housing 4; the passage is provided for extending an elongate member 2 (the elongate member 2 can be a spring or a soft steel rope) to allow extending of the two ends of the elongate member 2 to be at the two lateral sides of the screw hole 712, then a screw 3 is screwed into the screw hole 712 to increase stability of the lamp set after assembling.

When put into effect, as shown in FIGS. 2 and 3, the circular ring piece 5 is placed in the lamp housing 4 to make the engagement block 431 on the stepped portion 43 of the lamp housing 4 engaged into the recess 51 of the circular ring piece 5; and then the lamp holder 6 is placed into the lamp housing 4 to make the protrusion 63 provided on the external periphery of the lamp holder 6 fixedly engaged in the notches 521, 53 respectively provided on the circular ring piece 5 and the compressible ridge portion 52. Meantime, the lamp holder 6 presses against the circular ring piece 5, and the stepped portion 43 supports the circular ring piece 5, the lamp holder 6 is thereby firmly positioned in the lamp housing 4. And then the lamp locking-collar 7 which is provided with the gaskets 73, 74 connected to the lamp housing 4 to make the screw hole 712 and the through hole 441 of the grooves 711 and the groove 44 respectively of the reduced neck portion 71 on the lamp locking-collar 7 and the upper area of the inner wall of the lamp housing 4 aligned at the same side; at this time, the aligned grooves 711 and the groove 44 form a passage (not shown) for extending the elongate member 2 through to allow extending of the two ends of the elongate member 2 to be at the two lateral sides of the screw hole 712, then the screw 3 is screwed into the screw hole 712 to increase stability of the lamp set.

This way, by adjustment of an elastic force, the generality of use of the lamp of the present invention can be largely increased to suit various types of lamp holders and to automatically regulate the gap formed, not only keeping the immovability but also achieves the waterproof effect with the gaskets 73, 74 provided at the front end and inner wall of the lamp locking-collar 7.

Figure 6:
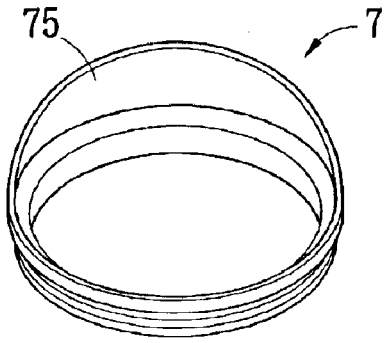
FIG. 6 is a perspective view showing the lamp locking-collar with an arci-form portion on the external periphery thereof.
Figure 4:
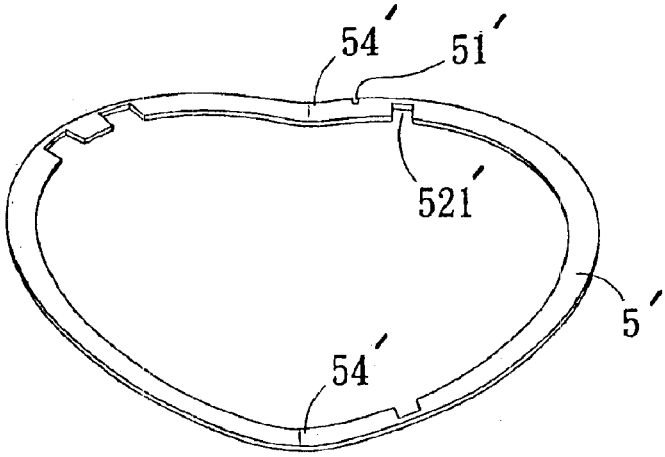
FIG. 4 is a perspective view showing the circular ring piece of the present invention is bended in lieu of forming the flexible compressible portion.
Figure 5:
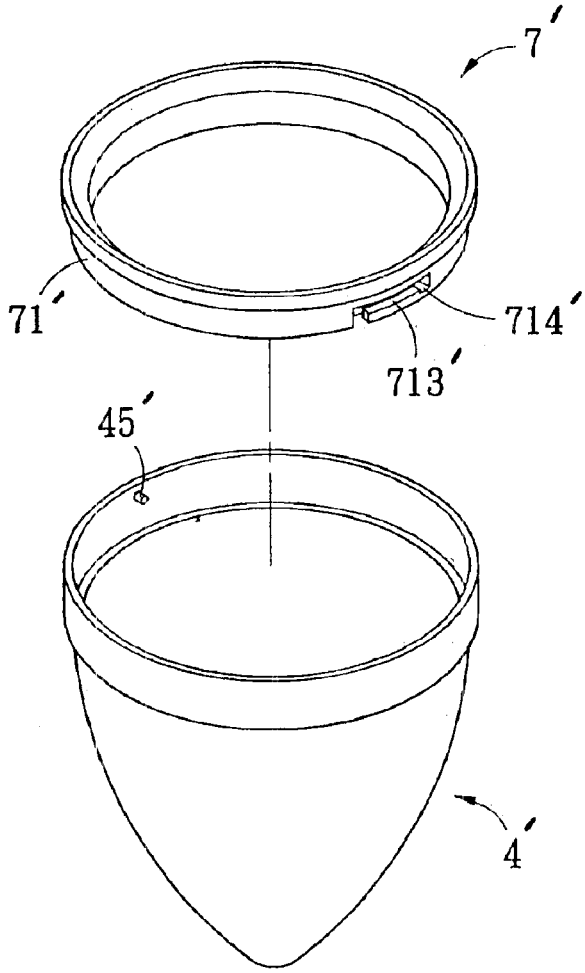
FIG. 5 is a perspective view showing the lamp locking-collar and the lamp housing could be connected by engagement.

Furthermore, FIG. 4 is a variation in use of a circular ring piece 5' and the lamp locking-collar 7. In FIG. 4, the circular ring piece 5' of the present invention FIG. 2 can also be bended to form multiple undulated concave portions 54' to derive the same effect of the compressible ridge 52 in FIG. 2 for flexibility, without the actually ridge welded. The circular ring piece includes an engagement recess 51' and notches 521'. The mode of connecting the lamp locking-collar 7' with the lamp housing 4' can also be an engagement mode, such as shown in FIG. 5. On the reduced neck portion 71' of the lamp locking-collar 7', it comes with an engagement portion 713' and its tailing end comes with a cut engagement groove 714', while the inner wall of the lamp housing 4' comes with an engaging stud 45' in opposition to the lamp locking-collar 7'. When the lamp locking-collar 7' is rotated, the pressing force of the circular ring piece 5' fixes the engaging stud 45' into the engagement groove 714' to secure the lamp lock-collar 7' so it will not drop off when loosened after it engages with the lamp housing 4'. And as shown in FIG. 6, the lamp locking-collar 7 can also add to its design by providing a pliable arch-form portion 75 on the external periphery thereof.

Therefore, the present invention holds the following advantages:

1. The circular ring piece of the present invention can be bended to form a sheet member with multiple undulated concave portions, or a steel sheet can be pointed welded onto the circular ring piece to form convex compressible ridges; so when the circular ring piece and the lamp holder are sequentially placed in the lamp housing, by the flexibility of the circular ring piece, the lamp holder can be firmly mounted in the lamp housing; and when the locking-collar is connected to the lamp housing, the lamp holder will not shake to affect illumination.
2. The present invention has grooves on the lamp locking-collar and the lamp housing and an elongate member to be extended and engaged therein. Assembling is simple, and after assembling it is structurally secure. Production is convenient; the lamp locking-collar has gaskets filled therein to increase water resistance of the entire lamp.

In summary, the present invention can achieve the desired effect of being waterproof, secure, unshakeable, and convenient in assembling. The design is brilliant yet practical.

Having thus described the present invention, what I claim as new and desire to be secured by Letters Patent of the United States are:

1. An improved lamp structure for assembling comprising:

a lamp housing which is a cone-shaped barrel with a receiving space, and has holes on the surface for extending an electric wire through, and a stepped portion on the inner wall with an engagement block;

a circular ring piece placed in said lamp housing supported and fixed by said stepped portion, an engagement recess on an external periphery of the circular ring piece to make engagement of said engaging block in said recess, and on one side of said circular ring piece at least one compressible ridge with at least one notch;

a lamp holder for receiving a lamp bulb, and having a protrusion located on an external periphery thereof such that when the lamp holder is mounted in the lamp housing, the lamp holder abuts against the circular ring piece to thereby be fixed on the circular ring piece, and a lamp locking-collar that is a circular sleeve with a reduced neck portion adapted to connect to said lamp holder when said circular ring piece and said lamp holder are sequentially placed in said lamp housing.

2. The improved lamp structure of claim 1, wherein said compressible ridge is formed by point welding mutually spaced steel sheets onto said circular ring piece, said circular ring piece and said compressible ridge have respective notches aligned with each other.

3. The improved lamp structure of claim 1, wherein said circular ring piece is bent to form on the periphery thereof a plurality of undulated concave portions that form said compressible ridge.

4. The improved lamp structure of claim 1, wherein said reduced neck portion provided on the front end and inner wall of said lamp locking-collar has grooves with gaskets respectively therein to provide a waterproof engagement.

5. The improved lamp structure of claim 1, wherein said reduced neck portion provided on said lamp locking-collar is provided thereon with a first groove having a screw hole therein; said lamp housing is provided on the inner wall with a second groove corresponding with said first groove of said lamp locking-collar, said second groove has a through hole to make a passage when said two grooves are aligned with each other in connection of said lamp locking-collar and said lamp housing; said screw hole and said through hole respectively of said grooves are located at the same side of said lamp housing; said passage is provided for extending an elongate member through to allow extending two ends of said elongate member to be at two lateral sides of said screw hole, then a screw is screwed into said screw hole to get increased stability of said lamp structure after assembled.

6. The improved lamp structure of claim 1, wherein said lamp holder is formed by connecting the ends of a cover and a shell respectively, said shell has an opening on one end with a predetermined size for receiving a lamp bulb and a space therein for receiving said lamp bulb.

7. The improved lamp structure of claim 1, wherein said reduced neck portion provided on said lamp locking-collar is provided thereon with an engagement portion, the inner wall of said lamp housing is provided with an engagement stub in opposition to said lamp locking-collar, so that when said lamp locking-collar is rotated, it is connected with or released from said lamp housing.

8. The improved lamp structure of claim 1, wherein said elongate member is a spring.

9. The improved lamp structure of claim 1, wherein said elongate member is a steel rope.

* * * * *